US005357188A

United States Patent [19]

Takeda et al.

[11] Patent Number: 5,357,188

[45] Date of Patent: Oct. 18, 1994

[54] CURRENT MIRROR CIRCUIT OPERABLE WITH A LOW POWER SUPPLY VOLTAGE

[75] Inventors: Isoshi Takeda; Shigeyoshi Hayashi, both of Kyoto, Japan

[73] Assignee: Rohm Co., Ltd., Kyoto, Japan

[21] Appl. No.: 918,449

[22] Filed: Jul. 22, 1992

[30] Foreign Application Priority Data

Jul. 25, 1991 [JP] Japan ..... 3-208595

[51] Int. Cl.[5] ..... G05F 3/26

[52] U.S. Cl. ..... 323/315

[58] Field of Search ..... 323/315, 316, 317, 312

[56] References Cited

U.S. PATENT DOCUMENTS

| | | | |
|---|---|---|---|
| 4,540,896 | 9/1985 | Tanaka | 307/264 |
| 4,553,048 | 11/1985 | Bynum et al. | 307/350 |
| 5,180,966 | 1/1993 | Sugawara et al. | 323/308 |
| 5,187,429 | 2/1993 | Phillips | 323/314 |
| 5,235,218 | 8/1993 | Matsuo et al. | 307/443 |

FOREIGN PATENT DOCUMENTS

| | | | |
|---|---|---|---|
| 3420068 | 12/1984 | Fed. Rep. of Germany | 323/315 |

*Primary Examiner*—Steven L. Stephan
*Assistant Examiner*—Adolf Berhane
*Attorney, Agent, or Firm*—Braumbaugh, Graves, Donohue & Raymond

[57] ABSTRACT

The emitter of a first pnp transistor is connected to a power supply voltage via a first resistor. The base and collector of the first transistor are not only connected to each other but connected to a ground terminal via a current source. The emitter of a second pnp transistor is connected to the power supply voltage via a second resistor. The bases of the first and second transistors are connected to each other. An input terminal of this current mirror circuit is connected to the emitter of the first transistor, and an output terminal is connected to the collector of the second transistor.

2 Claims, 2 Drawing Sheets

CURRENT MIRROR CIRCUIT OPERABLE WITH A LOW POWER SUPPLY VOLTAGE

BACKGROUND OF THE INVENTION

The present invention relates to current mirror circuits. More specifically, the invention relates to a current mirror circuit that is used in a signal processing circuit of audio equipment, video equipment, etc., and is operable with a low power supply voltage.

FIG. 5 shows an example of a conventional current mirror circuit, in which pnp transistors are employed on the side of a positive power supply voltage $V_{cc}$. This circuit consists of transistors $Q_1$ and $Q_2$ and resistors $R_1$ and $R_2$. The emitter of the transistor $Q_1$ is supplied with the voltage $V_{cc}$ via the resistor $R_1$. The base and collector of the transistor $Q_1$ are not only connected to each other but connected to an input terminal. The emitter of the transistor $Q_2$ is supplied with the voltage $V_{cc}$ via the resistor $R_2$. The base and the collector of the transistor $Q_2$ are connected to the base of the transistor $Q_1$ and an output terminal, respectively.

Since the bases of the transistors $Q_1$ and $Q_2$ are interconnected and therefore at the same voltage, when the transistors $Q_1$ and $Q_2$ are in an active state, a voltage drop from the power supply terminal to the base of the transistor $Q_1$ is equal to a voltage drop from power supply terminal to the base of the transistor $Q_2$. That is, a voltage drop across the resistor $R_1$ plus 1Vf (voltage corresponding to the base-emitter internal potential barrier) is equal to that of a voltage drop across the resistor $R_2$ plus 1Vf.

Therefore, the relationship between respective currents flowing through the resistors $R_1$ and $R_2$ is determined in accordance with resistance values of the resistors $R_1$ and $R_2$. In particular, if such resistance values are made equal to each other, the two currents flowing through the resistors $R_1$ and $R_2$ become substantially the same.

As a result, apart from a difference between very small, negligible current components, it can be said that an output signal current $I_{out}$ flowing from the output terminal to a circuit of the following stage or a load is the same as an input signal current $I_{in}$ flowing from the, input terminal to a circuit of the preceding stage. If only a current variation component is particularly selected as the signal current, the input signal current and the output signal current will coincide with each other. For the above reasons, this type of circuit is now widely used to invert the direction of the signal current.

As described above, in the conventional current mirror circuit, the voltage drop from the power supply terminal to the base voltage of the transistor $Q_1$ is a sum of the voltage drop across the resistor $R_1$ and 1Vf. Since the input terminal is directly connected to the base of the transistor $Q_1$, a voltage drop from the power supply terminal to the input terminal also takes the same value.

The above voltage relationship means that if an input signal voltage exceeds the power supply voltage $V_{cc}$ minus the above voltage drop, the direction of the signal current cannot be inverted properly, that is, the above circuit does not operate normally. In other words, the power supply voltage $V_{cc}$ should have a margin of not less than the voltage drop across the resistor $R_l$ plus 1Vf with respect to the effective signal voltage.

However, with the conventional current mirror circuit, which is based on the power supply voltage having enough margin, the circuit design of equipment is now in a very difficult situation because of the recent requirements in connection with the equipment down-sizing, specifically the requirement that portable equipment having a small battery be kept operable for a long time, and because of such limitations on the circuit design as a reduction of the breakdown voltage due to the miniaturization of IC patterns.

SUMMARY OF THE INVENTION

In order to solve the above problem in the art, an object of the invention is to realize a current mirror circuit that can operate normally even with a smaller difference between a power supply voltage and the maximum value of an input signal voltage, to thereby contribute to the increase of the freedom of the circuit design of equipment which is required to have low power consumption and low power supply voltages.

According to the invention, a current mirror circuit comprises:

a first and a second reference voltage terminal;

a first and a second resistor that are connected to the first and second reference voltage terminal, respectively;

a constant current source;

a first transistor having an emitter that is connected to the first reference voltage terminal via the first resistor, and a base and a collector that are not only connected to each other but connected to the second reference voltage terminal via the constant current source; and a second transistor of the same junction type as the first transistor, the second transistor having an emitter that is connected to the first reference voltage terminal via the second resistor, and having a base that is connected to the base of the first transistor;

wherein the emitter of the first transistor and the collector of the second transistor are connected to an input terminal and an output terminal of the current mirror circuit, respectively.

DESCRIPTION OF THE PREFERRED EMBODIMENTS

Figure 1:
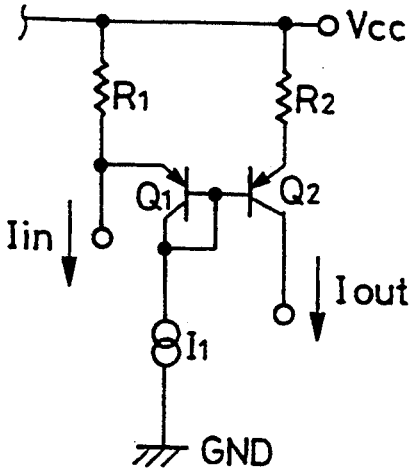
FIG. 1 shows a current mirror circuit according to the invention.
Figure 5:
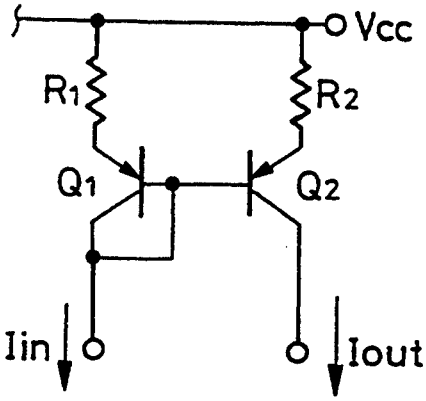
FIG. 5 PRIOR ART
FIG. 5 shows a conventional current mirror circuit.

FIG. 1 shows a current mirror circuit according to the present invention.

As shown in FIG. 1, the current mirror circuit includes pnp transistors $Q_1$ and $Q_2$ and resistors $R_1$ and $R_2$. The emitter of the transistor $Q_1$ is connected to a power supply terminal via the resistor $R_1$. The base and collector of the transistor $Q_1$ are not only connected to each other but connected to a ground terminal via a constant current source. The emitter of the transistor $Q_2$ is also connected to the power supply terminal via the resistor $R_2$. The bases of the transistors $Q_1$ and $Q_2$ are interconnected. An input terminal of the current mirror circuit is connected to the emitter of the transistor $Q_1$, and an output terminal is connected to the collector of the transistor $Q_2$.

The transistors $Q_1$ and $Q_2$ may be npn transistors. The power supply terminal may be another type of bias point, and the ground terminal may be another type of reference point.

In the current mirror circuit having the above construction, the transistor $Q_1$ is always kept in an active state by means of the constant current source that produces a current $I_1$. Since the bases of the transistors $Q_1$ and $Q_2$ are interconnected and have the same voltage, when the transistors $Q_1$ and $Q_2$ are in an active state, a voltage drop from a power supply terminal to the base of the transistor $Q_1$ is equal to a voltage drop from the power supply terminal to the base of the transistor $Q_2$. That is, a voltage drop across the resistor $R_1$ plus 1Vf is equal to a voltage drop across the resistor $R_2$ plus 1Vf.

Therefore, as in the case of the conventional circuit, the relationship between respective currents flowing through the resistors $R_1$ and $R_2$ is determined in accordance with resistance values of the resistors $R_1$ and $R_2$. In particular, if such resistance values are made equal to each other, the two currents flowing through the resistors $R_1$ and $R_2$. become substantially the same.

Further, since the input terminal is connected to the connection point of the emitter of the transistor $Q_1$ and the resistance $R_1$, the current flowing through the resistance $R_1$ takes a value equal to the sum of an input signal current $I_{in}$ flowing from the input terminal to the circuit of the preceding stage and an emitter current of the transistor $Q_1$. Therefore, apart from a difference between very small, negligible current components originating from, for instance, variations of the base currents and device characteristics, it can be said that an output signal current $I_{out}$ flowing from the output terminal to a circuit of the following stage or a load is the same as the current flowing through the resistor $R_1$.

Considering the fact that the current flowing through the resistance $R_1$ is kept constant by means of the constant current source, if a current variation component is particularly selected as the signal current, the input signal current and the output signal current will coincide with each other and the direction of the signal current is inverted.

In this manner, the above current mirror circuit has the same function as the conventional circuit as long as the current variation component is made the signal current.

In addition, since the input terminal is connected to the connection point of the emitter of the transistor $Q_1$ and the resistor $R_1$, the voltage drop from the power supply terminal to the input terminal becomes smaller than the conventional circuit by 1Vf of the transistor $Q_1$.

Usually, 1Vf (voltage corresponding to the base-emitter internal potential barrier) is about 0.6–0.7V in the case of silicon transistors, which is never a negligible value in the present situation in which the power supply voltage is required to be reduced from 5V to 3.3V or less. The frequency of the inversion of the signal current flowing direction, which is conventionally once per 2–4 stages will be reduced to once per 3–5 stages. This will prevent the signal deterioration to thereby contribute to the improvement of circuit performance, and also will contribute to the increase of the circuit integration degree. Further, the freedom of circuit design will be greatly increased.

On the other hand, if a configuration constituted of the same number of stages as the conventional configuration is employed, it will be possible to construct an application circuit that operates with the power supply voltage that is smaller than the conventional case by 1Vf, with the aid of other improvements in the circuit configuration. As a result, it becomes possible to provide equipment having circuits of low power consumption.

It is noted that even if the transistors $Q_1$ and $Q_2$ are of npn-type, the above current mirror circuit works in entirely the same manner, except for the polarity of the power supply voltage $V_{cc}$ and the signal current flowing direction.

In the following, a differential signal output circuit which employs the above current mirror circuits is described with reference to FIG. 2.

The differential signal output circuit produces an output signal current $I_{out}$ in accordance with a difference between two input signal currents $I_{in1}$ and $I_{in2}$. Receiving the input signal current $I_{in1}$, a current mirror circuit 1 of the invention inverts the input signal current. A conventional current mirror circuit 3 again inverts the signal current thus inverted. Receiving the input signal current $I_{in2}$, a current mirror circuit 2 of the invention inverts the input signal current. The resulting inverted signal current is combined with the signal current from the circuit 3 to become an output signal current $I_{out}$. While the input signal current $I_{in1}$ is inverted two times, the input signal current $I_{in2}$ is inverted just once. Therefore, a difference between the two input signals is obtained in the output signal.

In this manner, the above differential signal output circuit can produce a differential output of the two input signal currents. Further, components of constant currents $I_1$ and $I_2$ can be canceled out in the process of taking the difference between the signal currents, the differential signal output circuit of FIG. 2 operates, even with a power supply voltage $V_{cc}$ that is smaller than the conventional one by 1Vf, in completely the same manner as a differential signal output circuit including only the conventional current mirror circuits.

Figure 2:
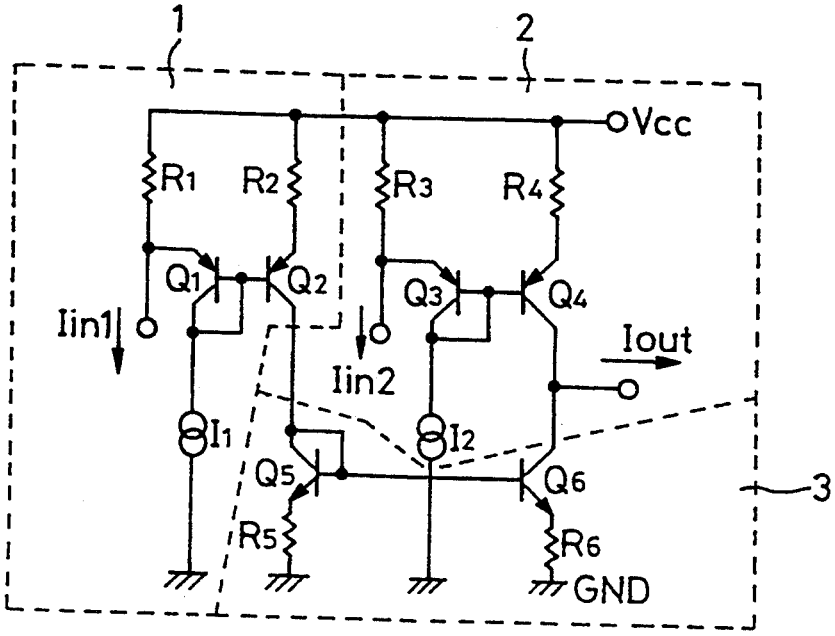
FIG. 2 shows a differential signal output circuit which employs two current mirror circuits of the type shown in FIG. 1.
Figure 3:
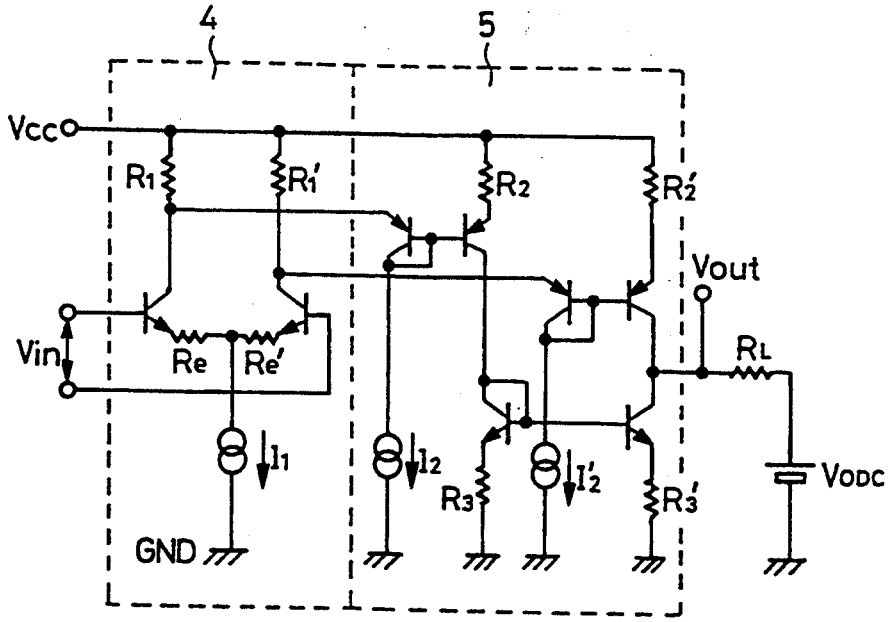
FIG. 3 shows a differential amplifier which employs the differential signal output circuit of FIG. 2.

FIG. 3 shows a differential amplifier to which the differential signal output circuit of FIG. 2 is applied, which amplifies a voltage difference $V_{in}$ across two input terminals to produce an output voltage $V_{out}$.

The voltage difference $V_{in}$ is differentially amplified by an input-stage circuit 4, and further differentially amplified by a differential signal output circuit 5 that share resistors $R_1$ and $R_1'$ with the input-stage circuit 4, so that a current having an amplified signal component is provided to a load $R_L$. The output voltage $V_{out}$ that is produced by the current-to voltage conversion by the load $R_L$ appear at an output terminal.

Since the differential signal output circuit 5 can receive a signal of a higher voltage level from the input-stage circuit 4 in the process of the signal amplification, the input-stage circuit 4 can also receive the voltage difference $V_{in}$ of a higher voltage level. As a result, the differential amplifier of FIG. 3 has an ability of removing larger in-phase components.

Figure 4:
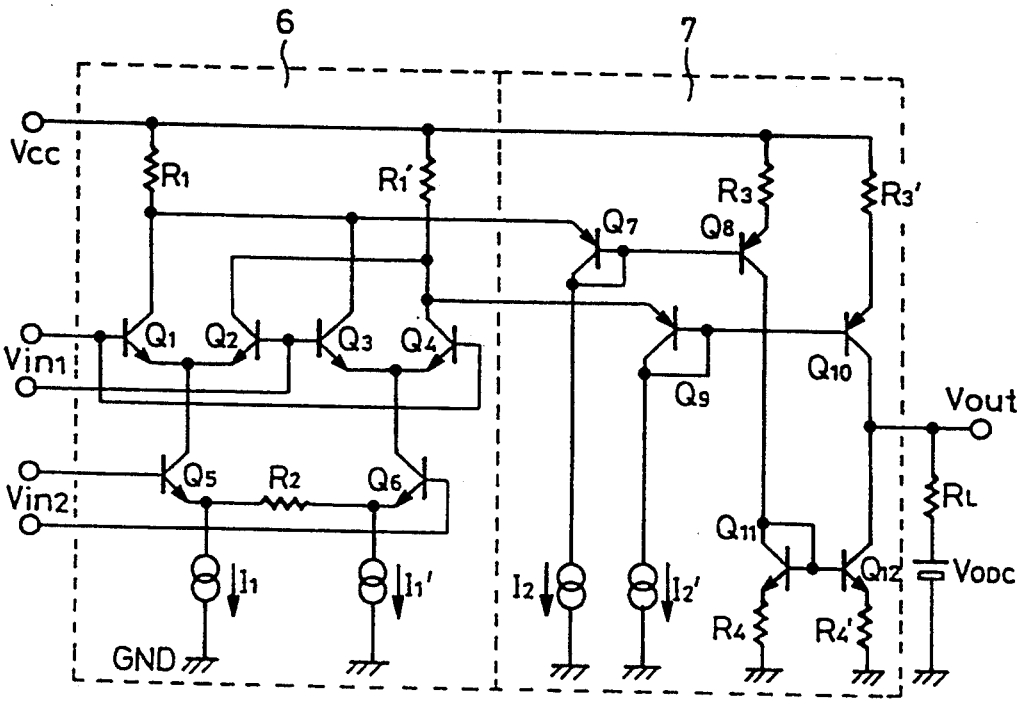
FIG. 4 shows a multiplier which employs the differential signal output circuit of FIG. 2.

FIG. 4 shows a multiplier to which the differential signal output circuit of FIG. 2 is applied, which produces an output voltage $V_{out}$ in accordance with a product of two voltage difference signals $V_{in1}$ and $V_{in2}$.

The two voltage difference signals $V_{in1}$ and $V_{in2}$ are subjected to an operation by a 4-quadrant multiplication circuit 6 to provide two current signals having different phases, which are then differentially amplified by a differential signal output circuit 7 of the invention that shares resistors $R_1$ and $R_1'$ with the 4-quadrant multiplication circuit 6. A current having an amplified signal component is provided to a load $R_L$, which performs the current-to-voltage conversion on it to output a voltage $V_{out}$ from an output terminal.

Having the functions and advantages similar to those of the differential amplifier of FIG. 3 in the signal multiplication and amplification process, the multiplier of FIG. 4 can receive the voltage difference signals $V_{in1}$ and $V_{in2}$ having a higher voltage level. As a result, this multiplier has an ability of removing larger in-phase components, or can operate normally with the power supply voltage $V_{cc}$ having a lower value.

As described in the foregoing, according to the invention, the current mirror circuit can be realized that operates normally even if the difference between the power supply voltage and the maximum value of the input signal voltage is smaller than that in the conventional circuit by 1Vf. As a result, the invention can provide the following advantages. That is, the freedom of circuit design can be increased, and equipment can be provided that has high performance and is operable at low power consumption with low power supply voltages.

What is claimed is:

1. A current mirror circuit comprising:

a first reference voltage terminal and a second reference voltage terminal;

a first resistor and a second resistor that are connected to the first reference voltage terminal;

a constant current source;

a first transistor having an emitter that is connected to the first reference voltage terminal via the first resistor, and a base and a collector that are not only connected to each other but connected to the second reference voltage terminal via the constant current source; and a second transistor of the same junction type as the first transistor, the second transistor having an emitter that is connected to the first reference voltage terminal via the second resistor, and having a base that is connected to the base of the first transistor;

wherein the emitter of the first transistor and the collector of the second transistor are connected to an input terminal and an output terminal of the current mirror circuit, respectively.

2. The current mirror circuit of claim 1, wherein the first and second resistors have the same resistance.

* * * * *